United States Patent [19]

Malamed

[11] Patent Number: 4,672,722

[45] Date of Patent: Jun. 16, 1987

[54] SINGLE TAPE CLOSURE CONSTRUCTION

[75] Inventor: Josef Malamed, Rochelle Park, N.J.

[73] Assignee: JMW Textiles, New York, N.Y.

[21] Appl. No.: 856,466

[22] Filed: Apr. 28, 1986

[51] Int. Cl.[4] ..... A44B 18/00

[52] U.S. Cl. ..... 24/446; 24/445; 24/450; 128/DIG. 15; 2/DIG. 6

[58] Field of Search ..... 24/446, 447, 448, 449, 24/450, 451, 452, 306, 442, 443, 444, 445, 49 M; 2/DIG. 6; 128/DIG. 15; 248/205.2, 205.3, 309.1

[56] References Cited

U.S. PATENT DOCUMENTS

| | | | |
|---|---|---|---|
| 2,976,914 | 3/1961 | Miller | 24/450 |
| 3,009,235 | 11/1961 | DeMestral | 24/445 |
| 3,057,354 | 10/1962 | Roberts et al. | 2/DIG. 6 |
| 3,130,111 | 4/1964 | Izumi . | |
| 3,387,345 | 6/1968 | Savoir . | |
| 3,415,300 | 12/1968 | Worcester | 248/205.2 |
| 3,467,077 | 9/1969 | Cohen | 128/DIG. 15 |
| 3,534,957 | 10/1970 | Norman et al. | 128/DIG. 15 |
| 3,577,607 | 5/1971 | Ikoma | 24/445 |
| 3,688,348 | 9/1972 | Klotz et al. . | |
| 4,058,853 | 11/1977 | Boxer et al. . | |
| 4,247,967 | 2/1981 | Swinton . | |
| 4,273,130 | 6/1981 | Simpson | 128/DIG. 15 |

FOREIGN PATENT DOCUMENTS

| | | | |
|---|---|---|---|
| 2160586 | 12/1985 | United Kingdom | 24/442 |

OTHER PUBLICATIONS

Velcro Brand Fastening Products, one sheet, date given Sep. 1972.

*Primary Examiner*—Victor N. Sakran
*Attorney, Agent, or Firm*—McAulay, Fields, Fisher, Goldstein & Nissen

[57] ABSTRACT

A single tape fastener construction comprises an elongated tape having a plurality of alternating strips of hook and pile members. Each strip is disposed in an acute angle with respect to the longitudinal edge of the tape.

A method for fabricating a closure using such tape is also disclosed.

8 Claims, 6 Drawing Figures

SINGLE TAPE CLOSURE CONSTRUCTION

BACKGROUND OF THE INVENTION

The present invention relates to fastening tapes using hook and pile type fasteners.

Hook and pile type fasteners generally sold under the trademark of Velcro and described in U.S. Pat. Nos. 3,000,384 and 3,009,235 are conventionally sold in tapes, wherein one tape contains a continuous surface of the hook type material and the other tape contains a continuous surface of the pile type material. If one desires to make a fastener from this material, a piece of the hook type tape is cut off and a piece of the pile type tape is cut off and thereafter used for fastening.

The disadvantage of this type of construction is that two separate tapes are needed to create the resulting fastener.

U.S. Pat. No. 4,058,853 discloses means for connecting together socks during washing so as to maintain the socks together as a pair. A fastening device is disclosed which includes strips of velcro tape having a pile portion and a hook portion immediately adjacent thereto. These portions are designed to interact with corresponding pile and hook portions on the other sock.

U.S. Pat. Noo. 3,688,348 discloses a velcro band for fastening together socks and has a tape with alternating hook and loop patches.

U.S. Pat. No. 4,247,967 discloses a shoe lace having male and female type velcro tapes along opposite ends of the laces. This causes the laces to engage wherever they cross.

U.S. Pat. Nos. 3,387,345 and 3,130,111 relate to the use of velcro tapes with a loop portion and a hook portion superimposed thereon and extending beyond the height of the loop portion.

The above-mentioned patents have the disadvantage of not being able to provide a single tape fastener construction which would ensure engagement of the tapes when the fastener is cut from the single tape.

SUMMARY OF THE INVENTION

The main object of the present invention is to eliminate the disadvantages of the prior art and to provide a single tape fastener construction which can be cut to provide a fastener from the single tape.

A further object of the present invention is the provision of a fastener tape which can be used in place of any closures heretofore used.

These and other objects of the present invention are achieved in accordance with the present invention by the tape fastener construction having integral alternating strips of hook and pile members woven preferably as a one-piece fabric, wherein each strip is disposed at an acute angle with respect to the longitudinal edge of the tape.

In a preferred embodiment, the acute angle is from 40° to 60° and preferably 45°. Furthermore, the tape can be woven in any width.

These and other features and advantages of the present invention will become apparent from the detailed description thereof taken with the drawings, wherein:

DETAILED DESCRIPTION OF THE INVENTION

Figure 1:
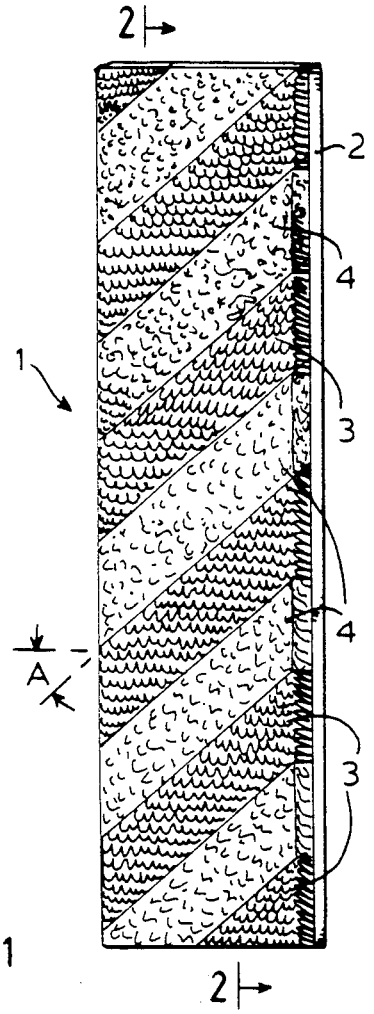
FIG. 1 is a plan view of a tape in accordance with the present invention.
Figure 2:
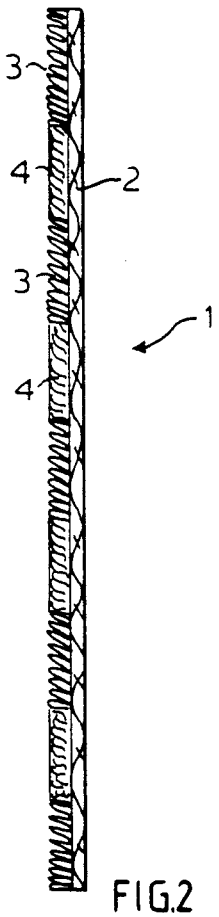
FIG. 2 is a sectional view of the tape of FIG. 1 along line II—II.

As shown in FIGS. 1 and 2, the single tape fastener construction 1 in accordance with the invention comprises integral alternating strips 3, 4 of hook and pile members. The strips 3, 4 are disposed in an alternating manner and each is disposed at an angle A to the longitudinal edge 2A of the back surface 2 of the tape. As is conventional, the tape 1 may be woven or fabricated as a one-piece fabric and may be made in any width as desired by the user.

Figure 3:
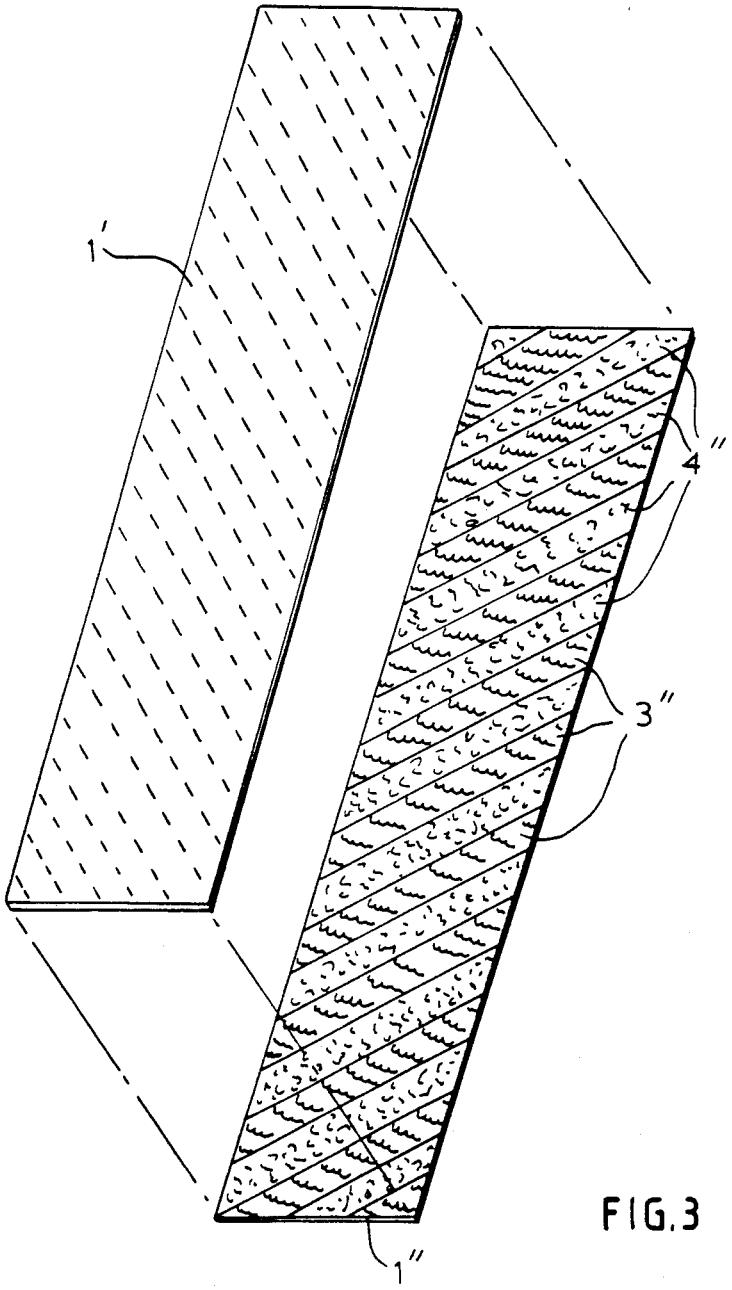
FIG. 3 is a perspective view of two tapes cut from the tape of FIG. 1 to form a fastener in accordance with the invention.
Figure 4:
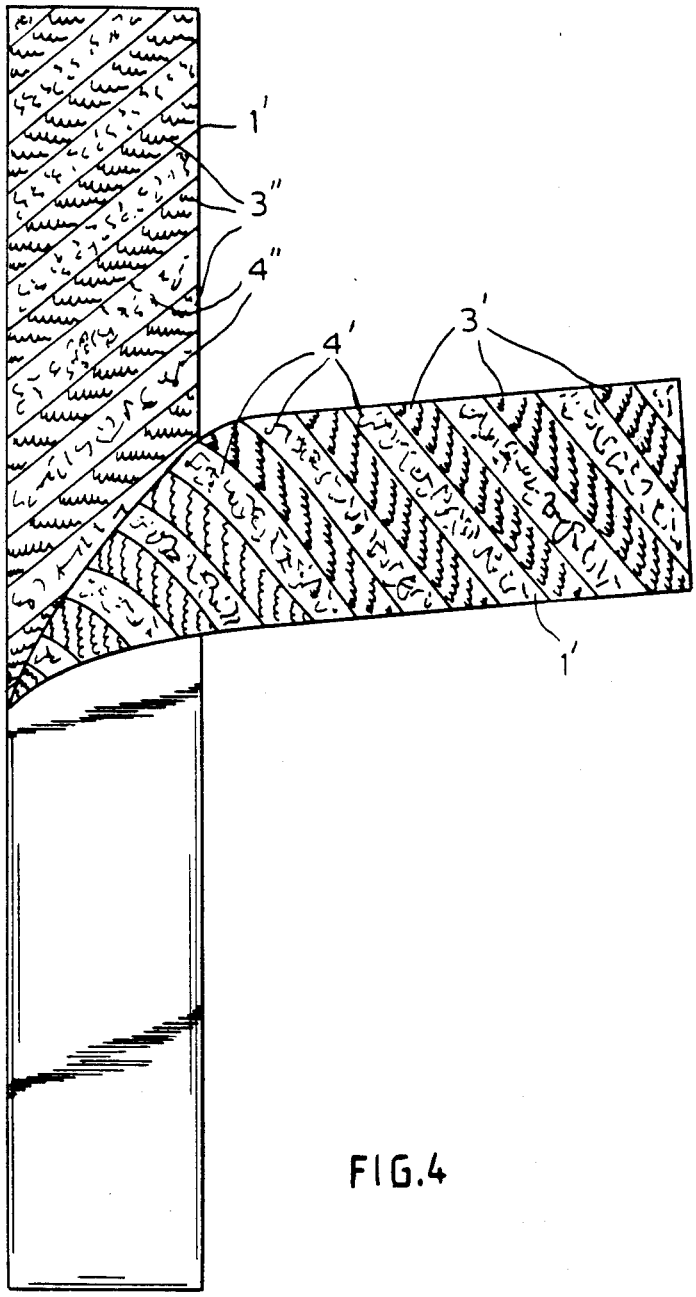
FIG. 4 is a top plan view of two superimposed tapes showing them in partially engaged position for illustrative purposes.

FIGS. 3 and 4 show how the tape is advantageously utilized. If two pieces 1' and 1'' are cut from tape 1, a fastener can be formed. The two pieces 1' and 1'' can be sewn onto a garment and when placed face to face in opposite angular orientation as shown, will guarantee a fastening no matter what their relative longitudinal orientation is. This fact can be seen from FIGS. 5 and 6.

Figure 5:
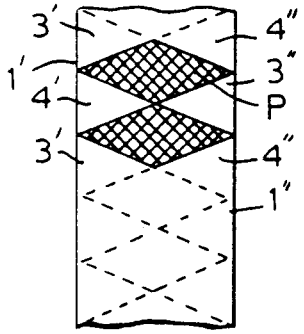
FIG. 5 shows the engaging portions of the tape when in a first orientation.

In FIG. 5, pieces 1' and 1'' are shown with fastening strips 3' and 4' disposed in one angular orientation and fastener strips 3'' and 4'' in the opposite orientation so that when they overlap, they cross in the form of an X, as shown clearly in FIG. 4. With the relatively longitudinal offset shown, the hatched portions P show two instances of the overlap of the mating connector portions.

Figure 6:
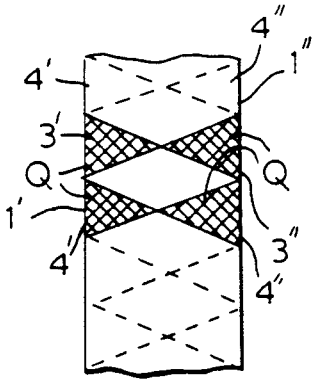
FIG. 6 shows the engaging portions of the tape in another orientation.

FIG. 6 shows the same two pieces 1' and 1'' however, with a different relatively longitudinal offset so that the mating portions will now be the hatched sections Q shown therein all along the sections. Thus it can be seen that the two pieces 1' and 1'' can have any relative longitudinal offset between the two shown in FIGS. 5 and 6, and the same amount of engaging portions will overlap, thereby assuring engagement of the two pieces 1' and 1''.

The angle of the strips 3, 4 preferably range from 40° to 60°, although 45° is the most preferable.

Additionally, the height of the hooks must be substantially equal to the height of the pile to ensure an efficient closure.

It will be appreciated that the instant specification and claims are set forth by way of illustration and not limitation, and that various modifications and changes may be made without departing from the spirit and scope of the present invention.

What is claimed is:

1. A tape fastener construction comprising: a backing member, a plurality of alternating strips of hook and pile members on one side of said backing member, where each strip is disposed at approximately the same acute angle with respect to the longitudinal edge of the tape, said tape being adapted to be cut so as to provide two separate fastener to be fastened together in reversed orientation to each other.

2. The construction according to claim 1, wherein the acute angle is from 40° to 60°.

3. The construction according to claim 2, wherein the acute angle is 45°.

4. The construction according to claim 1, wherein the height of the hook strips is substantially equal to the height of the pile strips.

5. The construction accordance to claim 1, wherein the fastener is a one-piece fabric construction.

6. The construction according to claim 1, in which said alternating strips of hook and pile members are contiguous to each other.

7. A method of fastening together two elements comprising providing a tape having alternating hook and pile strips on one side of the tape disposed at approximately the same acute angle with respect to the longitudinal edge of the tape, cutting the tape to provide two fasteners, and attaching a first of said fasteners to one of said elements and the other of said fasteners to the other of said elements in reversed orientation to said first fastener.

8. The method of claim 7 in which one of said fasteners is longitudinally offset with respect to the other.

* * * * *